United States Patent [19]

Boyd

[11] 4,398,587

[45] Aug. 16, 1983

[54] RADIANT ENERGY REFLECTOR DEVICE

[76] Inventor: Michael D. Boyd, 30 Cowper St., Ainslie, Australian Capital Territory, Australia

[21] Appl. No.: 193,134

[22] Filed: Oct. 2, 1980

Related U.S. Application Data

[63] Continuation of Ser. No. 917,370, Jun. 20, 1978, abandoned, which is a continuation-in-part of Ser. No. 746,844, Dec. 2, 1976, abandoned.

[51] Int. Cl.[3] ..... E06B 9/262; E06B 9/30

[52] U.S. Cl. ..... 160/178 R; 160/166 R; 160/236; 350/97; 350/103

[58] Field of Search ..... 160/166 R, 236, 178 R; 350/292, 97, 102, 263, 103, 276 R

[56] References Cited

U.S. PATENT DOCUMENTS

| | | | |
|---|---|---|---|
| 1,271,800 | 7/1918 | Sutton | 160/236 X |
| 2,103,788 | 12/1937 | Mohrfeld | 160/236 |
| 2,119,992 | 6/1938 | Johnson | 350/97 X |
| 2,142,629 | 1/1939 | Clark | 160/236 X |
| 2,146,816 | 2/1939 | Grassby | 160/236 X |
| 2,167,149 | 7/1939 | Grote | 350/103 X |
| 2,209,355 | 7/1940 | Schmitz | 160/236 X |
| 2,774,421 | 12/1956 | Lion | 350/1.1 X |
| 3,012,294 | 12/1961 | Waldor | 49/84 X |
| 3,236,290 | 2/1966 | Lueder | 160/309 X |
| 3,393,034 | 7/1968 | Imai | 350/276 R |
| 3,438,699 | 4/1969 | Seeger | 350/276 R |
| 3,461,013 | 8/1969 | Gewiss | 52/799 X |
| 3,540,282 | 11/1970 | Kohler et al. | 350/97 X |
| 4,120,565 | 10/1978 | Rabl et al. | 350/292 X |

FOREIGN PATENT DOCUMENTS

| | | | |
|---|---|---|---|
| 1135369 | 4/1957 | France | 160/236 |

*Primary Examiner*—Rodney H. Bonck

*Attorney, Agent, or Firm*—Zarley, McKee, Thomte, Voorhees & Sease

[57] ABSTRACT

Radiant energy screens are constructed as louvred screens, with the louvre elements each having second-surface retro-reflective elements on or in their outwardly facing surfaces. The inwardly facing surfaces of the louvre elements may be highly reflective to reduce their emissivity. The reflecting surfaces of the retro-reflective elements may be, inter alia, inclined elongate reflectors, cube-corner reflectors, or lens and mirror combinations.

11 Claims, 14 Drawing Figures

RADIANT ENERGY REFLECTOR DEVICE

This application is a continuation of application Ser. No. 917,370, filed June 20, 1978 and now abandoned, which is itself a continuation-in-part of application Ser. No. 746,844, filed Dec. 2, 1976 and now abandoned.

This invention concerns radiant energy reflecting devices, and in particular provides a radiant energy reflecting screen which can be used to form a solar energy barrier to prevent the penetration of unwanted energy into a shaded space. The invention has particular, but not exclusive, application to solar energy screens which are constructed as louvred screens, latticed screens or folded or gathered screens. The term "louvred screens" will generally be understood to include venetian blinds, louvred storm windows, and louvred doors and shutters.

Other areas of application of the present invention include grilles to allow the passage of fluid media, but not radiant energy, for example ventilation grilles for equipment and for buildings.

The screen of the present invention utilises reflecting members which are equipped with "second surface retro-reflective elements".

Retro-reflectors are reflecting bodies which reflect incident radiation back in the direction from which it is incident. They generally take one of three basic forms, namely (a) two or three planar reflectors at right angles to each other, (b) a lens with a mirror in its focal plane, and (c) a concave mirror with a smaller mirror at or near its focus. Each of these basic forms may be either a first-surface reflector (in which reflection occurs on the front face of the reflector) or a second-surface reflector (in which the incident radiation penetrates a transparent material, the front surface of which constitutes the first face, and reflection occurs at the second or rear face of the transparent material).

In more detail, the property of retro-reflection is exhibited where two reflectors are placed at right angles to each other. An incident energy ray in any plane which is reflected from one reflector to the other will be reflected in a parallel (but displaced) plane. Furthermore, if three reflectors are placed at right angles to each other (so as to form the internal corner of a cube), an incident energy ray which is reflected sequentially from each of the three reflectors, will be reflected in a parallel (but displaced) path. Such reflectors have been called "retro-reflectors", "retro-directive mirrors", and "cube-corner reflectors". The principle of retro-reflectivity is further described in, for example, the "Encyclopedia of Science and Technology" published by the McGraw-Hill Book Company, Inc., in 1960, under the heading "Mirror Optics".

The closest prior art to the present invention is believed to be the venetian blind assembly illustrated in U.S. Pat. No. 2,103,788 (to Mohrfeld). That specification discloses venetian blinds in which each slat of the blind has one surface which comprises a plurality of longitudinally extending, adjoining, narrow, highly reflecting surfaces disposed at an angle of approximately 45° to the plane of the slat and at angles of approximately 90° to each other. Such a surface comprises a two-plane, first-surface retro-reflector as discussed above, and such a surface does under certain conditions operate to reduce the amount of solar energy penetrating into a space shaded by the venetian blind. I have found, however, that blinds constructed in accordance with Mohrfeld can, over a range of slat and sun angles, reflect a substantial proportion of the incident energy into the shaded space. I have deduced that these inwardly directed rays have eminated from the extremities of the retro-reflector elements, where they have not been retro-reflected, but have been singly reflected at an oblique angle to the slat, and have thus been directed inwards.

The present invention seeks to re-direct these oblique rays, by incorporating a refractor element into each retro-reflector. The processes will be illustrated later.

It should be noted that the principle of a reflector element and a cooperative refractive element encompasses other retro-reflective constructions, such as the lense/mirror combinations referred to above.

Re-reflection of incident energy into the shaded space is also a problem with the highly reflective surfaces disclosed in Australian patent specification No. 203,859.

It is a prime objective of the present invention to provide a radiant energy screen which can be used in place of venetian blinds and the like to reduce the transferrence of radiant energy into the shaded space by re-reflection.

According to the present invention, there is provided a radiant energy screen bounded by, inter alia, an imaginary outer surface and an imaginary inner surface, said screen comprising a plurality of lamellar radiant energy reflecting members, each member being characterised by (a) being of elongate form and adapted to be located with a first longitudinal edge on said inner surface and a second longitudinal edge on said outer surface; and (b) being constructed with a plurality of second-surface retro-reflecting elements formed in or attached to the surface of said member that is usually inclined towards or facing said outer surface. Preferably the retro-reflective elements of the reflecting members are cube-corner reflectors, or comprise a lens element in cooperation with a reflecting surface.

The radiant energy reflecting members used in the present invention may be formed in any suitable manner, including rolling, casting or stamping the desired reflective surface configuration into a body, such as venetian blind strip material, and subsequently (if necessary) applying a coating of a reflective material. Other methods of forming the radiant energy reflecting members will be described later.

To further understand the present invention, this description will now continue with reference to the accompanying drawings, in which:

FIG. 1 illustrates a portion of a known form of radiant energy reflector device, namely the venetian blind slat construction chosen by Mohrfeld for the screen illustrated and described in his U.S. Pat. No. 2,103,788;

Figure 1:
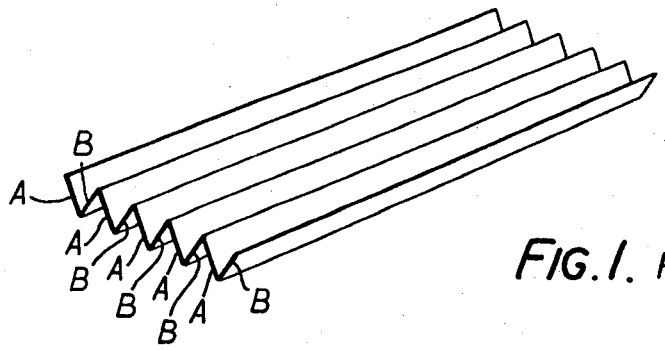
FIG. 1. PRIOR ART
Figure 2:
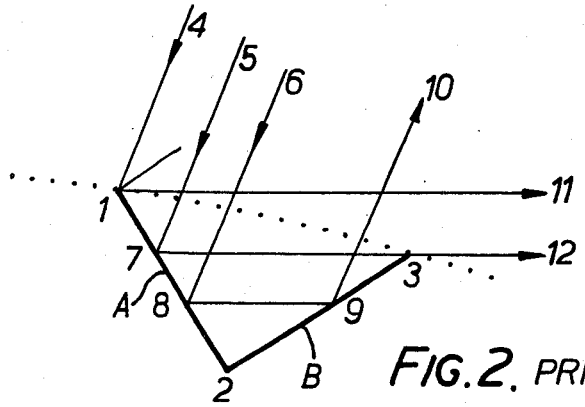
FIG. 2. PRIOR ART
FIG. 2 illustrates the retro-reflective property of the surface of the embodiment of FIG. 1, and its failure to be retro-reflective in general.

Referring firstly to FIG. 1, there is shown a two-plane first-surface retro-reflective device which consists of a longitudinally corrugated aluminium reflector having reflective surfaces A and B disposed substantially at right angles to each other. Referring to FIG. 2, which is a cross-section through two reflective surfaces of the device of FIG. 1, it will be seen that, in general, when a beam of energy is incident upon the reflective surface, a portion of the beam, typified by the illustrated beam path 6-8, will be reflected from the surface A to the surface B along the path 8-9 and, on re-reflection from the surface B, will emerge from the reflector along path 9-10 in a parallel plane. It will also be apparent from FIG. 2 that another portion of the beam of energy incident upon the reflective surface, typified by beam paths 4-1 and 5-7, will be reflected once only to be scattered in direction 1-11 and 7-12. Thus it can be seen from this Figure that in general, only a portion of an incident beam of energy is truly retro-reflected, unless the incident beam strikes at one particular angle, nevertheless, in the terminology of this field, the structure of FIG. 2 is called a retro-reflector.

Figure 3:
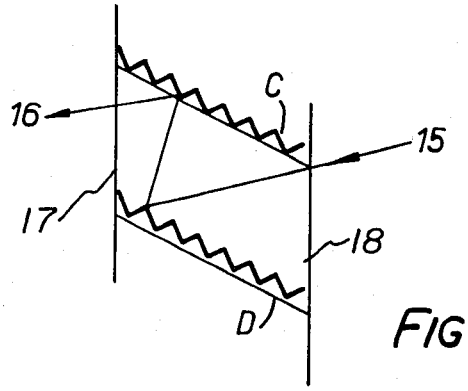
FIG. 3. PRIOR ART
FIGS. 3 and 4 illustrate possible re-reflection paths for incident radiant energy in louvred screen devices which incorporate slats having the structure of FIG. 1.
Figure 4:
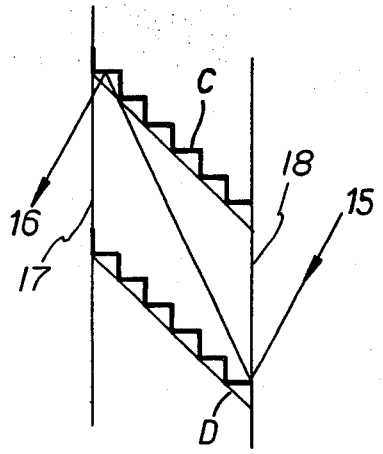
FIG. 4. PRIOR ART

FIGS. 3 and 4 illustrate a venetian blind constructed of slats having the shape illustrated in FIG. 1, positioned between an imaginary inner surface 17 and an imaginary outer surface 18, and show how re-reflection of incident radiation can be undesirable. FIG. 3 illustrates a case in which slats C and D are oriented so that a ray entering along path 15 is deflected from one slat to the next and into the shaded space along path 16. Similarly, referring to FIG. 4, it can be seen that such undesirable re-reflection into the shaded space may take place when a high elevation beam 15 strikes the outer end of the reflector surface D. It can be seen from these diagrams that, in practice, inward re-reflections from a low sun angle (FIG. 3) occur as a result of a beam such as 4-1-11 in FIG. 2.

I have found that such re-reflection from louvred screens having the basic slat construction of FIGS. 3 and 4 can be substantially reduced if the individual slats (reflecting members) have their outwardly disposed surfaces constructed to include, or comprise, a plurality of second surface retro-reflecting elements.

Figure 5:
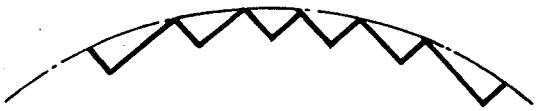
FIGS. 5 and 6 are cross-sectional representations of alternative reflecting surface configurations for use, in conjunction with an over-lying transparent medium, as reflecting members in the present invention.
Figure 6:
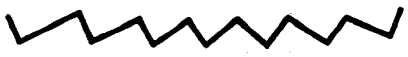

FIGS. 5 and 6 illustrate alternative reflecting surface constructions which may be used with the reflecting members of the present invention. These structures are particularly useful because they can be incorporated into conventional venetian blind strip material without having to resort to complicated and expensive new fabrication techniques and equipment.

In FIG. 5, the corrugated reflecting surface is so constructed that the included angles between the peaks and troughs of the corrugations remain unaltered at approximately 90°, but the reflecting surface widths are varied so that the energy reflecting member has a curved profile. The reflective structure shown in FIG. 6 is also corrugated but the reflective surfaces are constructed so that the upper included angle between the reflective elements is 90° only at the mid-width point of the lamellar structure. With this construction, alternate reflective facets no longer lie in parallel planes.

Figure 7:
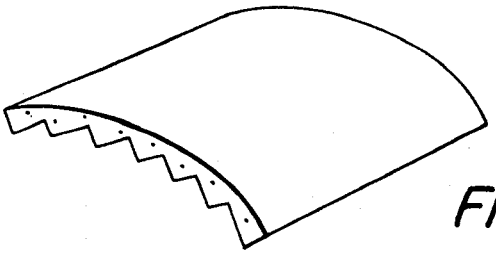
FIGS. 7 and 8 illustrate second surface radiant energy reflecting members which are constructed to have a reflecting surface configuration as illustrated in, respectively, FIGS. 5 and 6.
Figure 8:
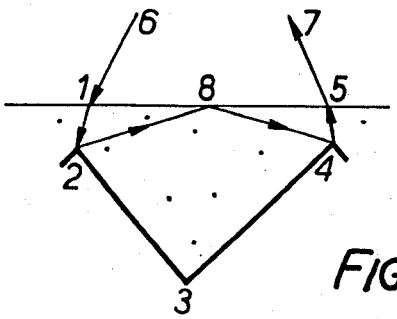

FIGS. 7 and 8 illustrates an actual slat (reflecting member) that may be used in the present invention. These reflecting members are formed as two-plane second-surface reflectors, which may conveniently be fabricated by extruding a transparent venetian blind slat with corrugations on the underside, configured in accordance with the principles illustrated in FIGS. 5 and 6, then coating the underside of the slat with a reflective film. FIG. 8 is a cross-section through such a reflecting member and illustrates that a ray incident along path 6-1, strikes the surface of the transparent material at point 1, and is refracted along path 1-2. It is then reflected along path 2-8 to point 8 on the surface, where it is totally internally reflected. It then strikes the reflecting surface at 4 and leaves the structure along path 5-7 at a different angle to the ray emerging along path 1-11 of FIG. 2, but nevertheless at an angle which would be effective to prevent energy penetrating a louvred screen by re-reflection, as shown in FIGS. 3 and 4. Thus, by uitlising this form of reflecting member, the undesirable reflections illustrates in FIGS. 3 and 4 may be reduced or eliminated.

Figure 9:
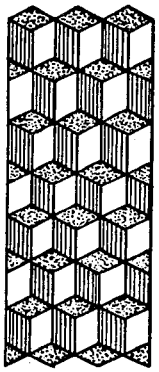
FIGS. 9 and 10 illustrate a retro-reflective surface utilising a cube-corner reflector.
Figure 10:
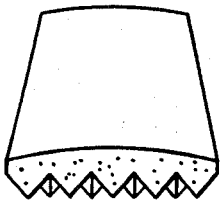

Turning now to FIGS. 9 and 10, there is shown a known form of three-plane, first-surface (FIG. 9) and second-surface (FIG. 10) reflector structure, namely an array of "cube-corner" reflectors, which may be embodied in a planar or curved venetian blind slat to form a reflecting screen of the present invention. When compared with similar two-plane reflectors, the reflecting structures of FIGS. 9 and 10 exhibit the further advantage that reflected incident energy is reflected in a parallel line, and not a parallel plane. Once again, for this form of reflecting surface to be used in the present invention, it must first be overlaid with a transparent medium, thus utilising the principles discussed above in relation to the embodiment of FIGS. 7 and 8.

Figure 11:
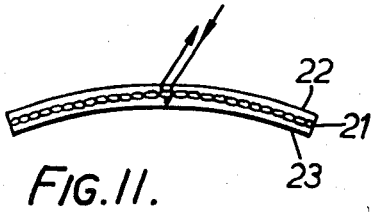
FIGS. 11 to 14 illustrate further slat constructions, utilising lens/focal plane mirror retro-reflectors and concave mirror/secondary mirror retro-reflectors, which the present inventor has designed for use with the reflecting members of the present invention.

It is also possible for the energy reflecting members used in the present invention to be constituted by a curved lens/focal plane mirror construction. As with two-plane and three-plane reflecting structures, these can provide retro-reflectivity in two dimensions (for example, in the form of an extruded transparent curved sheet with lens-profile surfaces, mounted over a mirror-surfaced base member) or in three dimensions (for example, in the form of an array of glass spherical beads, suspended over a curved reflective surface). FIG. 11 illustrates one such configuration in which elements 21 are transparent rods or spheres set in a matrix 22 of lesser refractive index, above a reflective surface 23.

Figure 12:
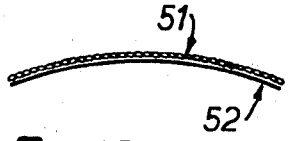

FIG. 12 illustrates a modified form of the venetian blind slat of FIG. 11. The slat of FIG. 12 has an outer surface 51 comprising a matrix of glass bead lens elements located in the surface of a transparent medium above a reflecting surface 52.

Figure 13:
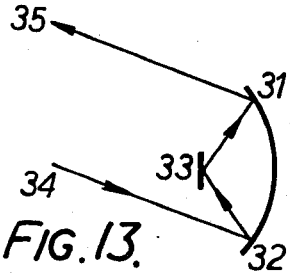
Figure 14:
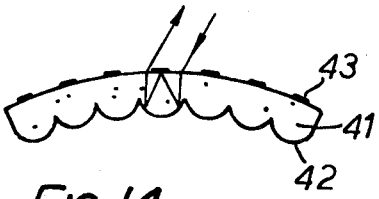

The last form of energy reflecting member for use in the present invention that is illustrated in the drawings is a curved lamellar body constructed as a concave mirror/secondary mirror retro-reflector (for example, a "cats-eye" retro-reflector). In FIG. 13, a concave mirror 31-32, which may be circular or parabolic in cross-section, has a small mirror 33 near its focus. A typical ray 34-32 is is retro-reflected through 180° to emerge along ray path 31-35. As with other retro-reflector types, these embodiments may be two-directional with longitudinally extending mirrors of constant cross-section, or they may be three dimensional, with primary mirrors formed of sphere segments, thus providing total retro-reflectivity rather than planar retro-reflectivity. FIG. 14 is a cross-section through a venetian blind slat, in which 41 is the transparent body of the slat, elements 42 are a series of concave reflectors formed on the rear of the slat, and elements 43 are small secondary reflectors formed on the transparent face of the slat.

Finally, it should be noted that since the energy reflecting members of the present invention are effective to reduce the transmission of energy by re-reflection when incorporated into louvred screens, it is possible to make the inward facing surfaces of such screens highly reflective, hence lowering their emissivity.

While the present invention has been described herein with reference to preferred embodiments, it will be generally understood by persons skilled in the art that various changes may be made and equivalents substituted for elements thereof without departing from the true spirit and scope of the present invention.

I claim:

1. A radiant energy screen bounded by, inter alia, an imaginary outer surface and an imaginary inner surface, said screen comprising a plurality of slats, each slat being lamellar and of elongate form, characterized in that:

(a) each slat has a plurality of retro-reflective structures embodied within the slat;

(b) the retro-reflective structures incorporate a body of material which is transparent to radiant energy, the outer surface of said body of transparent material forming one face of the structures;

(c) each slat, in use, is inclined at an angle relative to the said imaginary outer surface.

2. A radiant energy screen as defined in claim 1, in which each retro-reflective structure is of prismatic form and is formed at the back surface of said body of transparent material as groups of planar reflecting surfaces set substantially at right angles to each other.

3. A radiant energy screen as defined in claim 2, in which the number of planar reflecting surfaces in each said group is two.

4. A radiant energy screen as defined in claim 2, in which the number of planar reflecting surfaces in each said group is three.

5. A radiant energy screen as defined in claim 1, in which each retro-reflecting structure comprises a body of a material which is transparent to incident radiant energy, within or upon which there is located a lens element, the focal plane of said element falling within said transparent medium or at the rearmost boundary thereof, a reflecting surface being located at or near said focal plane.

6. A screen as defined in claim 5, in which each lens element comprises a spherical or part-spherical surface.

7. A screen as defined in claim 5, in which each lens element is cylindrical or part-cylindrical, and the axis of said cylinder or part-cylindrical surface is located parallel to the longitudinal direction of said elongate slat.

8. A screen as defined in claim 1, in which each retro-reflective structure comprises a body of a material that is transparent to incident radiant energy, within or at the rearmost surface of which is a concave reflecting surface, the focus of which is within or at the fore-most surface of said transparent material, a second reflecting surface being located at or near said focus.

9. A screen as defined in claim 8, in which each said concave reflecting surface has a spherical or paraboloid form.

10. A screen as defined in claim 8, in which each said concave reflecting surface is elongate in the elongate direction of said slats, and has a circular or parabolic cross-section.

11. A screen as defined in claim 1, in which the surface of each slat that is usually inclined towards or facing said inner surface is highly reflecting.

* * * * *